US007686628B2

(12) United States Patent
Lino et al.

(10) Patent No.: US 7,686,628 B2
(45) Date of Patent: Mar. 30, 2010

(54) ELECTRICAL CONNECTOR WITH IMPROVED CONTACT

(75) Inventors: Koichi Lino, Yokohama (JP); Guo-Jian Shen, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/998,056

(22) Filed: Nov. 28, 2007

(65) Prior Publication Data

US 2008/0124959 A1 May 29, 2008

(30) Foreign Application Priority Data

Nov. 28, 2006 (CN) ..... 2006 1 0097796

(51) Int. Cl.
*H01R 4/66* (2006.01)

(52) U.S. Cl. ..... 439/108; 439/79; 439/83

(58) Field of Classification Search ..... 439/79, 439/83, 108

See application file for complete search history.

(56) References Cited

U.S. PATENT DOCUMENTS

| | | | | |
|---|---|---|---|---|
| 5,256,085 | A * | 10/1993 | Tan et al. | 439/607 |
| 6,350,134 | B1 * | 2/2002 | Fogg et al. | 439/79 |
| 6,540,559 | B1 * | 4/2003 | Kemmick et al. | 439/608 |
| D505,919 | S | 6/2005 | Moritake | |
| 7,179,127 | B2 * | 2/2007 | Shiu | 439/608 |
| 7,247,058 | B2 * | 7/2007 | Reeser et al. | 439/701 |
| 2004/0229482 | A1 * | 11/2004 | Zhu et al. | 439/79 |

* cited by examiner

*Primary Examiner*—Tho D Ta
*Assistant Examiner*—Travis Chambers
(74) *Attorney, Agent, or Firm*—Andrew C. Cheng; Wei Te Chung; Ming Chieh Chang

(57) ABSTRACT

An electrical connector includes an insulating housing (1) defining a first direction and a plurality of conductive contacts (20) arrayed in the housing along the first direction. The contacts are divided into a first type and a second type and each includes a soldering portion extending out the insulating housing. The soldering portion of the second type is wider than that of the first type and distances between every adjacent soldering portions of the first and second type are the same.

2 Claims, 7 Drawing Sheets

ELECTRICAL CONNECTOR WITH IMPROVED CONTACT

BACKGROUND OF THE INVENTION

1. Field of the invention

The present invention relates to an electrical connector, especially to an electrical connector with ground contacts or power contacts thereof.

2. Description of Related Art

In high density current connector, a plurality of conductive contacts transferring signal are arrayed parallel in the housing along an elongated direction. Usually, the distance between adjacent contacts is more and more smaller due to miniaturization based on high density. And contacting portions each are wider than corresponding soldering legs so that the contacting portions can reliably engage with mating contacts of a mating connector and the distance between two adjacent soldering legs are enlarged, thereby avoidance of adjoining the adjacent soldering legs by weld raw materials is obtained. Power contact or grounding contacts might be added to optimize signal transfer or the connector, for example, a current connector disclosed in U.S. Pat. No. D505,919. The connector disclosed is provided with power contacts, which is larger than the signal contacts to transfer a larger current. The power contacts stand beside the signal contacts with a larger distance, which will increase the connector. More, the power contacts must be solely produced, which results in increasing cost of production.

Therefore, an improved electrical connector is desired to overcome the disadvantages of the prior arts.

SUMMARY OF THE INVENTION

An object of the present invention is to provide an electrical connector with improved grounding or power contacts.

In order to achieve above-mentioned object, an electrical connector comprises an insulating housing defining a first direction and a plurality of conductive contacts arrayed in the housing along the first direction. The contacts comprises a first type and a second type and each comprises a soldering portion extending out the insulating housing. The soldering portion of the second type is wider than that of the first type and distances between every adjacent soldering portions of the first and second type are the same.

Other objects, advantages and novel features of the present invention will become more apparent from the following detailed description of the present embodiment when taken in conjunction with the accompanying drawings.

DETAILED DESCRIPTION OF THE INVENTION

Figure 1:
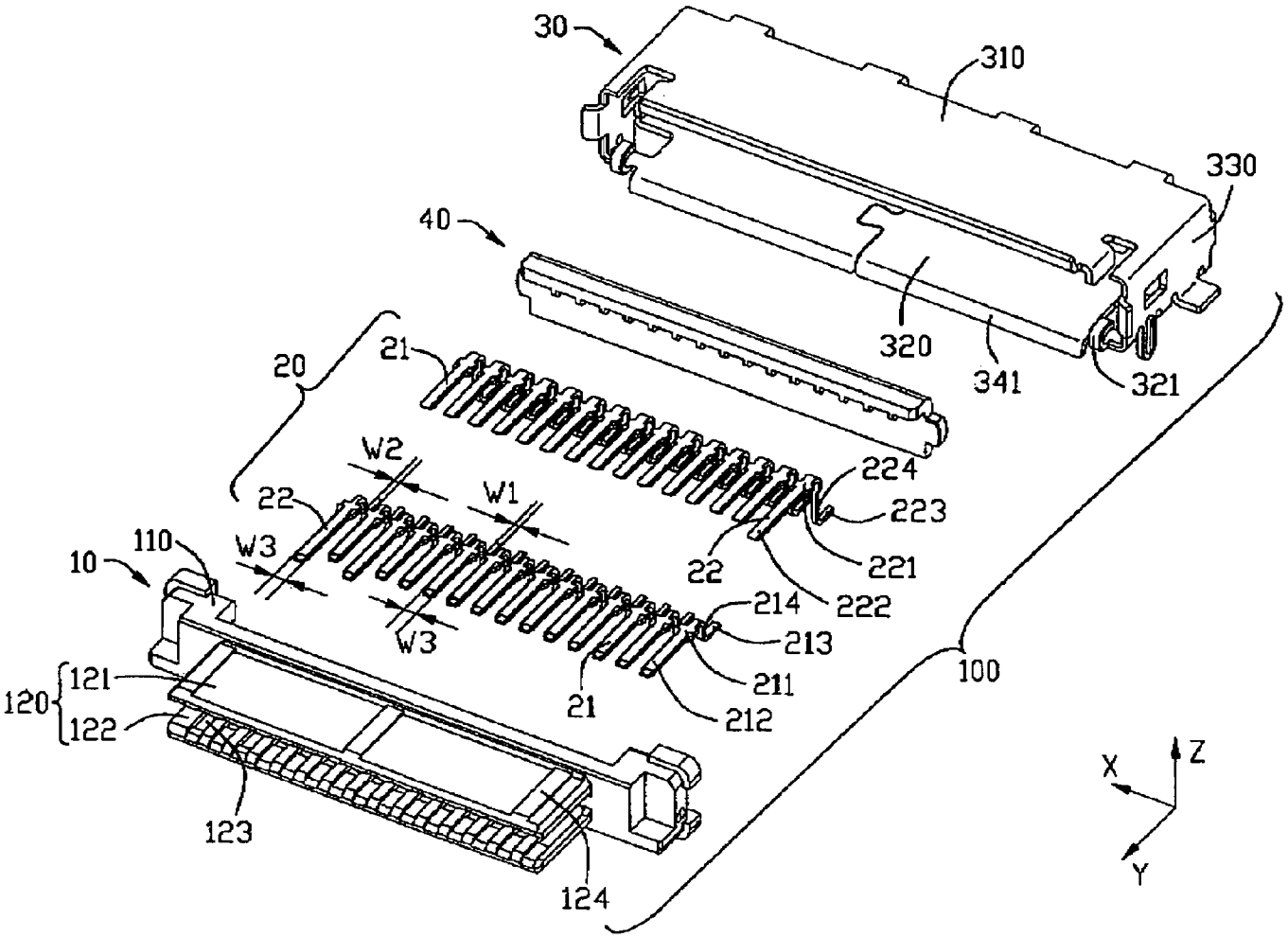
FIG. 1 is an exploded perspective view of the electrical connector in accordance with the present invention.

Reference will now be made to the drawing figures to describe the preferred embodiment of the present invention in detail.

Referring to FIG. 1, an electrical connector 100 in accordance with the present invention comprises an insulating housing 10 with a plurality of conductive contacts 20 assembled therein. A metal shield 30 is assembled to the housing 10 and a stopper 40 is provided at a rear portion of the housing 10.

Figure 4:
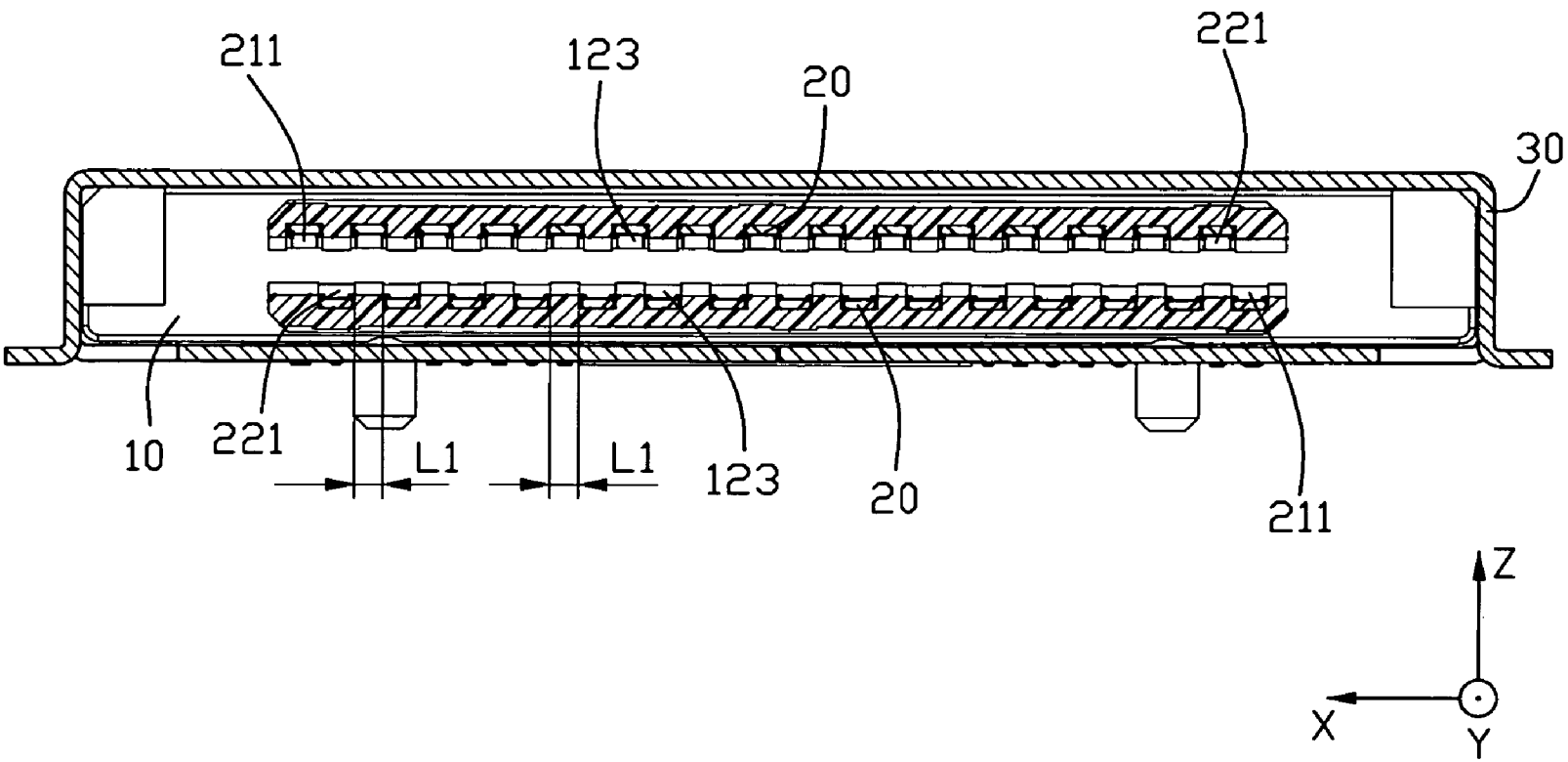
FIG. 4 is a cross-sectional views of FIG. 1 taken along line 4-4.

The insulating housing 10 includes an elongated base portion 110 defining a first direction ("X" direction) along the elongated direction and a mating portion 120. The base portion 110 has a front portion and a rear portion in a second direction ("Y" direction) perpendicular to the first direction. The mating portion 120 extends forward from the frond portion of the base portion 110. The mating portion includes an upper tongue 121 and a lower tongue 122 which is in parallel to the upper tongue 121. Two inner surfaces, which are face-to-face, of both the upper tongue 121 and the lower tongue 122 define a plurality of passageways 123 arranged offset and alternatively, see FIG. 4. The external surfaces, which are back-to-face, are provided with ribs 124 so as to prevent the upper and lower tongues from warping thereby ensuring predetermined coplanarity of the two tongues.

Figure 2:
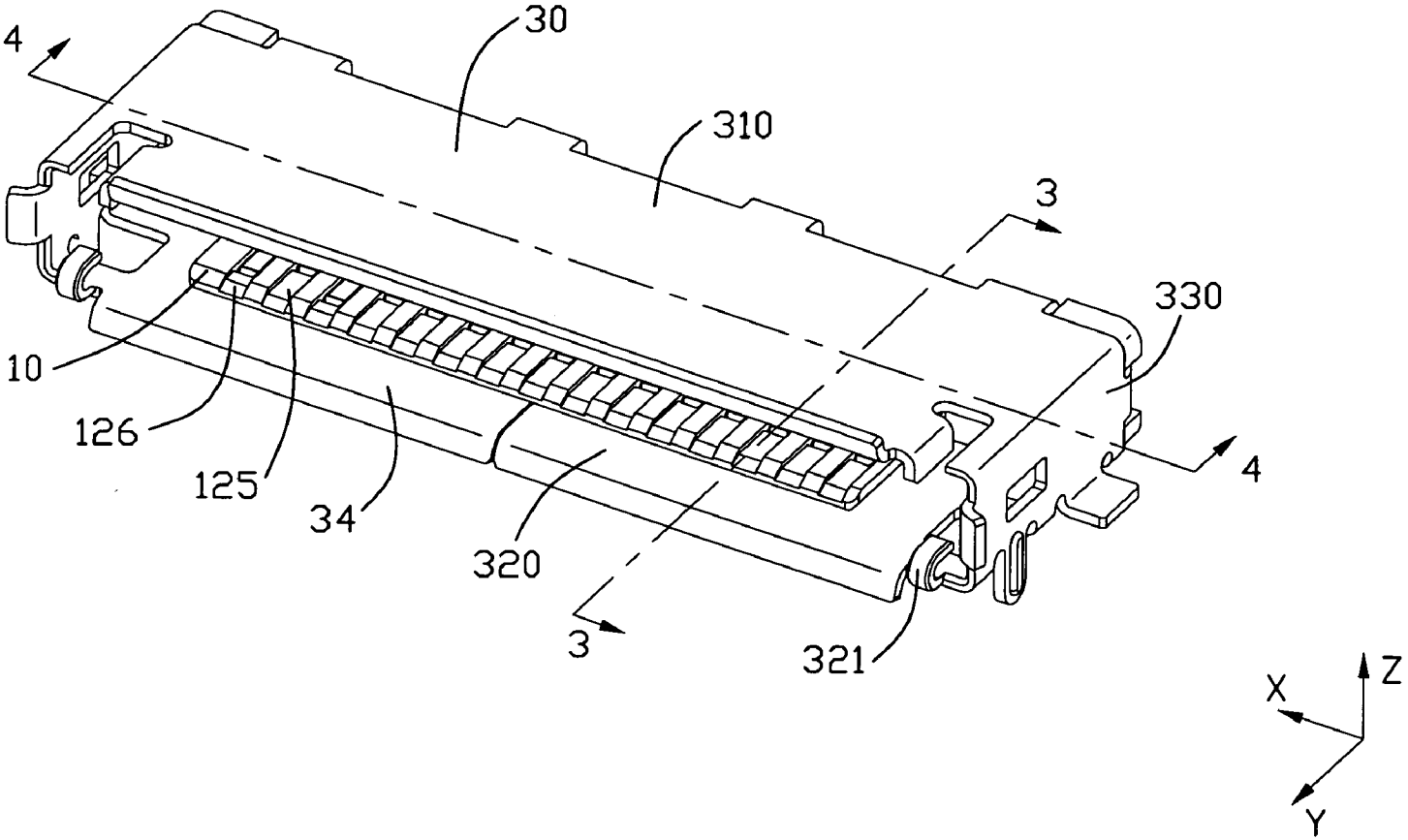
FIG. 2 is a front side perspective view of the connector shown in FIG. 1.
Figure 3:
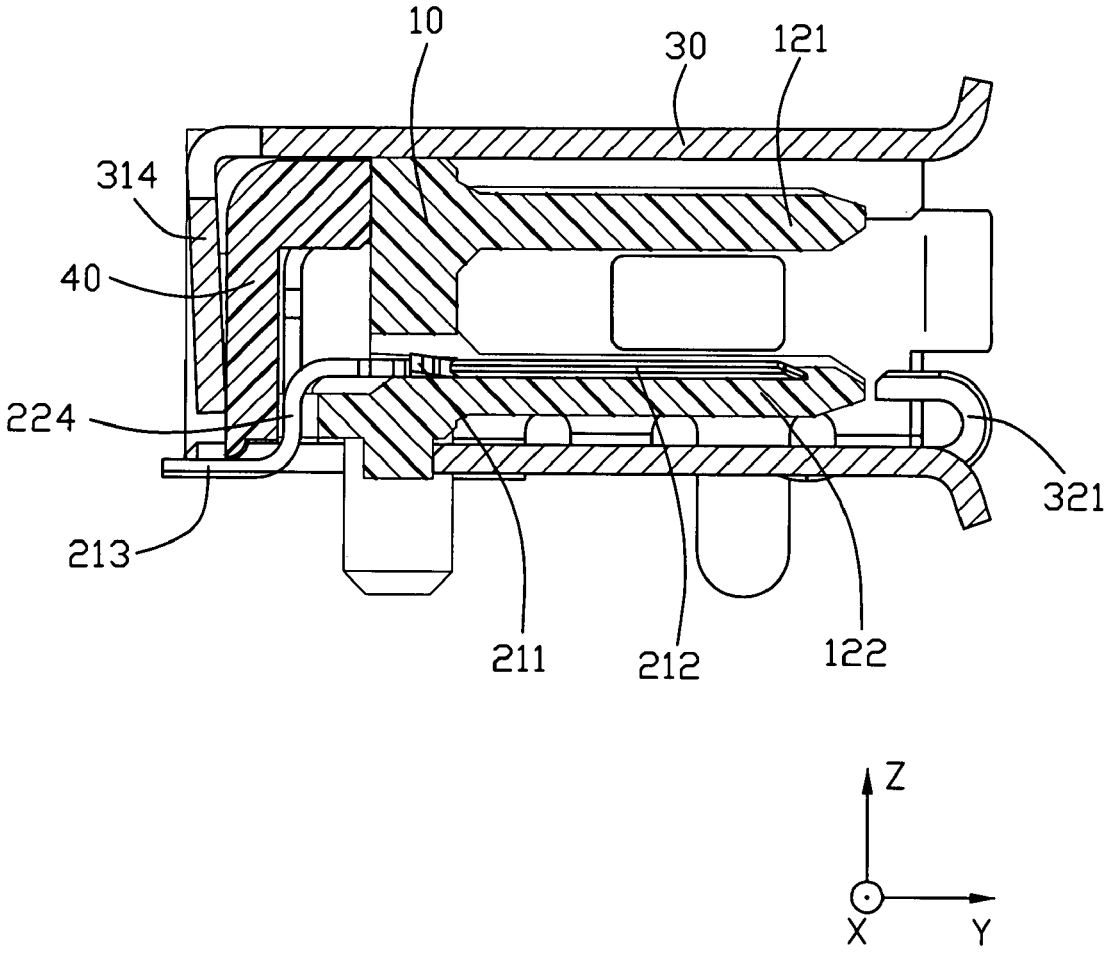
FIG. 3 is a cross-sectional views of FIG. 1 taken along line 3-3.

Referring to FIGS. 1 and 3, the plurality of contacts 20 are formed with retaining portions 211/221 secured on the base portion 110 of the housing 10. Each contact 20 further includes a contacting portion 212/222 extending forward from the retaining portion along the corresponding passageway 123 and a soldering portion 213/223 which is interconnected to the retaining portion by a connection portion 214/224. See FIG. 2, a blocking lug 125/126 is in the front of each passage and the lug 125 is longer than the lug 126 being adapted for corresponding contacting portion of the contact. The stopper 40 is assembled on the housing and positioned at the back of the connecting portion.

Figure 5:
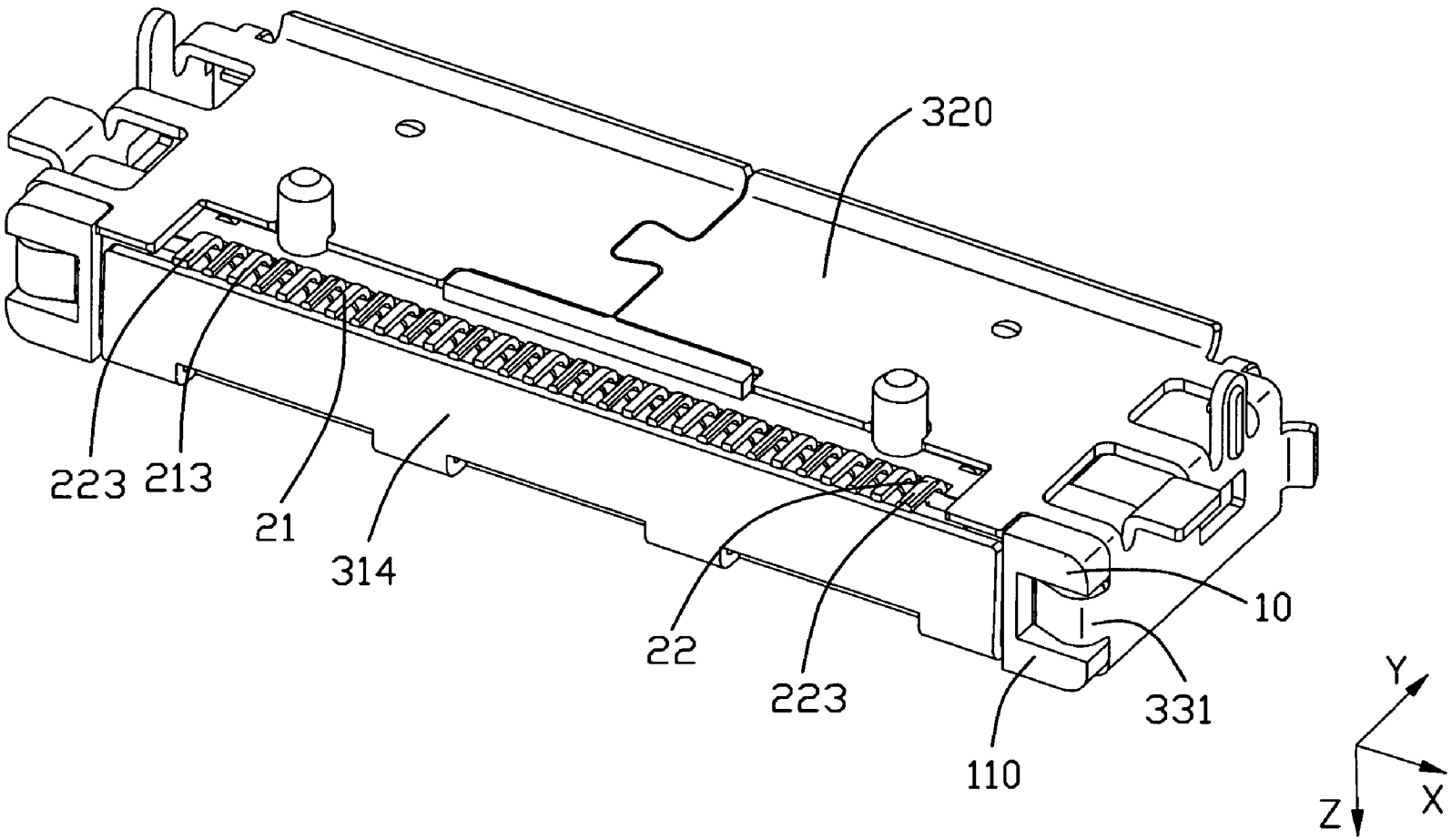
FIG. 5 is a bottom side perspective view of the connector.

The shield 30 includes an upper wall 310, a lower wall 320 and end walls 330 interconnecting the upper and lower walls 310, 320 thereby forming a frame encapsulating the housing 10. The front edge of the upper and lower walls form with an arc-shaped guiding portion 341 to function as a mating guide of a mating connector. An anti-disorientation arrangement 321 is arranged on a front end of the lower wall 320. An retaining portion 331 (see FIG. 5) is locked at two opposite ends of the base portions of the housing, thereby the shield is secured on the housing. Then a rear flap portion 314 of the upper wall 310 of the shield 30 is bent down right immediate to the stopper 40 to further secure the stopper 40 from detached from the housing 10. More, the stopper 40 blocks the connection portions 214/224 and the rear portion 314 so as to prevent rear portion 314 of the shield from contacting the connection portions 340 such that the short circuit is avoid. The shield 30 is assembled on the housing, thereby forming a mating cavity 34, as best shown in FIG. 2.

Figure 6:
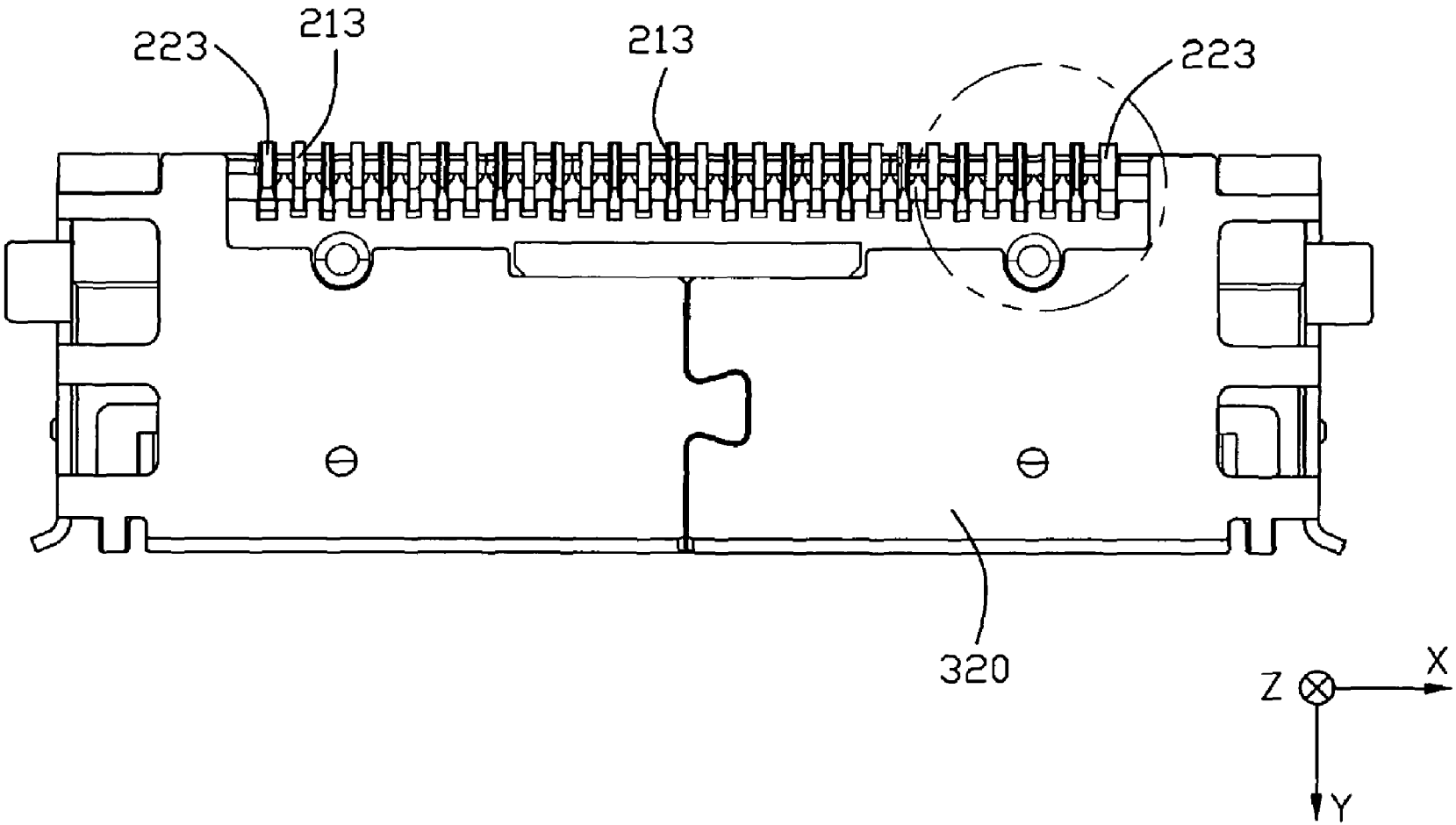
FIG. 6 is a top elevational view of the connector shown in FIG. 5.
Figure 7:
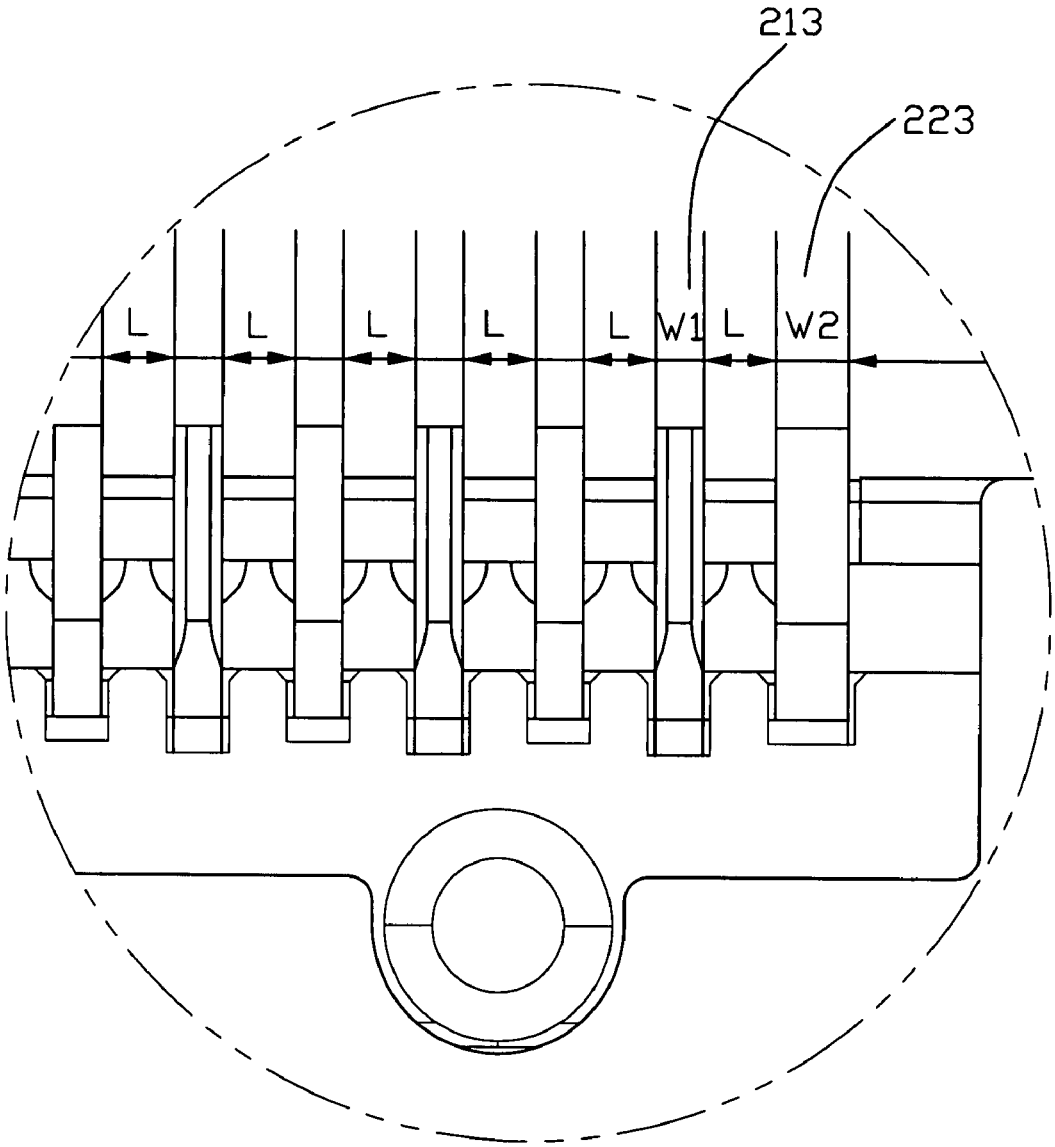
FIG. 7 is a partly enlarged view of the connector shown in FIG. 6.

Back to looking at FIG. 1 again, the contacts 20 is arranged in two rows, upper row receiving in the upper tongue 121 and lower row receiving in the row tongue 122. The soldering portions 213, 223 are arrayed in one line, see FIG. 5. Each row of contacts comprises a plurality of contacts 21 of first type transferring signal and one contact of second type 22 transferring power at one end of the row. The two second-type contacts of the upper and lower rows lie in opposite ends respectively. Widths of the contacting portion of the first and second types are the same, designated as W3, but width of the soldering portion of the first type designated as W1 is smaller than that of the second type designated as W2. After the contacts are assembled in the passageways of the housing, the contacting portion of the first and second types are placed with a same distance between adjacent contacts designated as L1 as seen in FIG. 6, and the soldering portions of the first and second types are placed also with a same distance between adjacent contacts designated as L as seen in FIG. 7. Said arrangement of first and second contacts can improve welding effect. More, the two contacts can be formed at same time and assembled in the housing also at same time.

Further, each contacting portion 212 and soldering portion 213 of the first type is of a same central line. Central lines of the contacting portion 221 and the soldering portion 223 of each second-type contact 22 are offset. The central lines of adjacent contacting portions are arrayed with a same distance interval, but the central line of the soldering portion of the second-type contacts 22 is at outside the corresponding central line of the contacting portion. In other word, the soldering portion of the second type is widen by enlarging its outside edge, thereby the soldering portion is improved and the distance between the adjacent soldering portion remains.

However, the disclosure is illustrative only, changes may be made in detail, especially in matter of shape, size, and arrangement of parts within the principles of the invention.

What is claimed is:

1. An electrical connector comprising:

an insulative housing defining two upper and lower mating tongues opposite and parallel to each other and commonly exposed in a same mating port; and first and second sets of contacts disposed in the housing, each of said contacts defining a contacting section and a soldering section, the soldering section defining a bottom solder face; wherein the contacting section of the first set of contacts are positioned on one of the upper mating tongue and the lower mating tongue, and the contacting section of the second set of contacts are positioned on the other of the upper mating tongue and lower mating tongue under a condition that a width of the contacting section of each of the first set of the contacts is essentially equal to that of the contacting section of each of the second set of contacts; wherein the soldering sections of the first set of contacts and those of the second set of contacts are alternatively arranged in one row under a condition that a width of each of the bottom soldering faces of the first set of contacts is larger than that of the bottom solder faces of the second set of contacts, while a distance between the neighboring soldering sections of the every adjacent two contacts keeps essentially the same throughout all said one row.

2. An electrical connector comprising:

an insulative housing defining two upper and lower mating tongues opposite and parallel to each other and commonly exposed in a same mating port; and a plurality of contact defining in at least two rows and positioned on the upper and lower mating tongue, each of said contact defining a contacting section for mating with a complementary connector and a soldering section for mounting to a printed circuit board; wherein the contacting sections of said contacts are arranged under a condition that a width of the contacting section of the at least two rows is essentially equal to each other and a distance of between the neighboring contacting sections of every adjacent two contacts keeps essentially the same throughout all said each row; wherein the solder sections of contacts are alternatively arranged in one row including two outermost solder sections of the two outermost contacts at two opposite ends of said one row, under a condition that a width of each of the soldering sections is essentially the same except that that of each of the two outermost solder section is larger, while a distance between the neighboring soldering sections of the every adjacent two contacts keeps essentially the same throughout all said one row.

* * * * *